US010959530B2

(12) United States Patent
Choi

(10) Patent No.: US 10,959,530 B2
(45) **Date of Patent: *Mar. 30, 2021**

(54) FOLDABLE SUPPORTING ASSEMBLY AND BED FRAME HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 65 days.

This patent is subject to a terminal disclaimer.

(21) Appl. No.: 16/506,575

(22) Filed: Jul. 9, 2019

(65) Prior Publication Data

US 2020/0022503 A1 Jan. 23, 2020

(30) Foreign Application Priority Data

Jul. 17, 2018 (CN) ..... 201821129834.2

(51) Int. Cl.
*A47C 19/12* (2006.01)
*A47C 19/02* (2006.01)
*A47C 19/00* (2006.01)

(52) U.S. Cl.
CPC ..... *A47C 19/126* (2013.01); *A47C 19/005* (2013.01); *A47C 19/027* (2013.01)

(58) Field of Classification Search
CPC ..... A47C 19/00; A47C 19/005; A47C 19/02; A47C 19/021; A47C 19/025; A47C 19/12
USPC ..... 5/200.1, 201, 202, 282.1, 285, 286, 288, 5/290
See application file for complete search history.

(56) References Cited

U.S. PATENT DOCUMENTS 769,949 A * 9/1904 Kutz ..... F16B 12/58 5/294
1,518,969 A * 12/1924 Dyke ..... F16B 12/56 5/290
1,617,865 A * 2/1927 Richardson ..... F16B 12/58 5/288
1,833,692 A * 11/1931 Silvio ..... F16B 9/052 5/238
2,492,070 A * 12/1949 Stone et al. ..... A47C 19/025 5/238
2,983,931 A * 5/1961 Nelson ..... F16B 12/54 5/238
8,832,876 B1 * 9/2014 Oh ..... A47C 19/12 5/116
8,978,176 B1 * 3/2015 Oh ..... A47C 19/12 5/400
9,492,017 B2 * 11/2016 Oh ..... A47C 17/64
(Continued)

*Primary Examiner* — Robert G Santos
(74) *Attorney, Agent, or Firm* — Morgan, Lewis & Bockius LLP

(57) ABSTRACT

A foldable supporting assembly includes an inner lateral bar unit, and first, second, third and fourth longitudinal bar units. The first and second longitudinal bar units are disposed at a first side, and rotatably connected with the first and second ends of the inner lateral bar unit. The third and fourth longitudinal bar units are disposed at a second side, and rotatably connected with the first and second ends of the inner lateral bar unit. When folded, one of the first and second longitudinal bar units is disposed between the inner lateral bar unit and the other one of the first and second longitudinal bar units, and one of the third and fourth longitudinal bar units is disposed between the inner lateral bar unit and the other one of the third and fourth longitudinal bar units.

20 Claims, 7 Drawing Sheets

(56) References Cited

U.S. PATENT DOCUMENTS

| | | | | |
|---|---|---|---|---|
| 10,702,070 | B2 * | 7/2020 | Oh | A47C 19/027 |
| 2014/0345047 | A1 * | 11/2014 | Oh | A47C 19/12 5/116 |
| 2015/0089740 | A1 * | 4/2015 | Oh | A47C 19/12 5/400 |
| 2018/0042391 | A1 * | 2/2018 | Oh | A47C 19/027 |
| 2020/0022501 | A1 * | 1/2020 | Choi | A47C 19/12 |
| 2020/0022503 | A1 * | 1/2020 | Choi | A47C 19/12 |
| 2020/0375367 | A1 * | 12/2020 | Qiu | A47C 19/021 |
| 2020/0378426 | A1 * | 12/2020 | Choi | A47C 19/025 |

* cited by examiner

FOLDABLE SUPPORTING ASSEMBLY AND BED FRAME HAVING SAME

CROSS-REFERENCE TO RELATED APPLICATIONS

The present application claims priority to Chinese Utility Model Application CN 201821129834.2 filed Jul. 17, 2018. The disclosure of the application is incorporated herein for all purposes by reference in its entirety.

FIELD OF THE INVENTION

The present invention generally relates to bed frames, and more particularly, to foldable supporting assemblies and bed frames having foldable supporting assemblies.

BACKGROUND

Beds are usually the main furniture in bedrooms and often occupy the majority of the space. In modern days, foldable beds become daily necessities in particular when the space is limited. Foldable beds are desirable because they are convenient to use and require less space for storage. However, some existing foldable bed frames, especially those double-layered frames (e.g., lateral or longitudinal bar unit made of a stack of bars), are not user-friendly. They cannot be folded well, and thus would take up a large space during transportation and storage.

Given the current state of the art, there remains a need for foldable beds and bed frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides foldable supporting assemblies and bed frames having such foldable supporting assemblies.

In various exemplary embodiments, the present invention provides a bed frame including an inner lateral bar unit, first and second outer lateral bar units, and first, second, third and fourth longitudinal bar units. The first outer lateral bar unit is disposed at a first side of the inner lateral bar unit. The second outer lateral bar unit is disposed at a second side of the inner lateral bar unit. The first and second longitudinal bar units are disposed between the inner and first outer lateral bar units. The third and fourth longitudinal bar units are disposed between the inner and second outer lateral bar units. Each of the first, second, third and fourth longitudinal bar units has a first end rotatably connected with a first end or a second end of the inner lateral bar unit, and a second end connected with a first end or a second end of the first or second outer lateral bar unit.

In some exemplary embodiments, a first coupler is fixedly coupled with the first end of the inner lateral bar unit, a second coupler is fixedly coupled with the second end of the inner lateral bar unit, and a third coupler of a substantially "L" shape is fixedly coupled with the first end of a respective longitudinal bar unit in the first, second, third and fourth longitudinal bar units. The first end of the respective longitudinal bar unit is rotatably connected with the first or second end of the inner lateral bar unit by a fastener through a hole formed in the third coupler and a hole formed in the first or second coupler.

In some exemplary embodiments, each of the inner lateral bar unit, the first and second outer lateral bar units, and the first and second longitudinal bar units includes an upper bar, a lower bar, and one or more supports disposed between the upper and lower bars.

In some exemplary embodiments, each end of the first and second outer lateral bar units includes a receptacle to receive the second end of the corresponding first, second, third or fourth longitudinal bar unit.

In some exemplary embodiments, each of the first, second, third and fourth longitudinal bar units includes an upper longitudinal bar and a lower longitudinal bar. The upper longitudinal bar includes a slot facing downwardly at the second end thereof. The lower longitudinal bar includes a first hole at the second end thereof. Each end of the first and second outer lateral bar units includes an upper receptacle at an upper portion thereof and a lower receptacle at a lower portion thereof. The upper receptacle is configured to receive the second end of the upper longitudinal bar of the corresponding first, second, third or fourth longitudinal bar unit, wherein the upper receptacle includes a pin removably engageable with the slot of the upper longitudinal bar. The lower receptacle is configured to receive the second end of the lower longitudinal bar of the corresponding first, second, third or fourth longitudinal bar unit, wherein the lower receptacle includes a second hole, wherein the lower longitudinal bar is connected with the lower receptacle by a fastener via the first and second holes.

In some exemplary embodiments, the bed frame further includes a plurality of receptacles and a plurality of lateral supporting bars. The plurality of receptacles, each made of a bent piece, is spatially disposed at the upper longitudinal bars of the first, second, third and fourth longitudinal bar units. Each lateral supporting bar has a first end removably received in a receptacle at the first or third longitudinal bar unit, and a second end removably received in a receptacle at the second or fourth longitudinal bar unit.

In various exemplary embodiments, the present invention provides a foldable supporting assembly including an inner lateral bar unit, and first, second, third and fourth longitudinal bar units. The inner lateral bar unit has a first end and a second end. The first and second longitudinal bar units are disposed at a first side of the inner lateral bar unit, each having a first end and a second end. The first end of the first longitudinal bar unit is rotatably connected with the first end of the inner lateral bar unit and the first end of the second longitudinal bar unit is rotatably connected with the second end of the inner lateral bar unit such that when folded, one of the first and second longitudinal bar units is disposed between the inner lateral bar unit and the other one of the first and second longitudinal bar units. The third and fourth longitudinal bar units are disposed at a second side of the inner lateral bar unit, each having a first end and a second end. The first end of the third longitudinal bar unit is rotatably connected with the first end of the inner lateral bar unit and the first end of the fourth longitudinal bar unit is rotatably connected with the second end of the inner lateral bar unit such that when folded, one of the third and fourth longitudinal bar units is disposed between the inner lateral bar unit and the other one of the third and fourth longitudinal bar units when folded.

In some exemplary embodiments, the first longitudinal bar unit is rotatable with respect to the inner lateral bar unit along a first axis at the first side of the inner lateral bar unit, the second longitudinal bar unit is rotatable with respect to the inner lateral bar unit along a second axis at the first side of the inner lateral bar unit, and the first and second axes are staggered with respect to the inner lateral bar unit. The third longitudinal bar unit is rotatable with respect to the inner lateral bar unit along a third axis at the second side of the inner lateral bar unit, the fourth longitudinal bar unit is rotatable with respect to the inner lateral bar unit along a fourth axis at the second side of the inner lateral bar unit, and the third and fourth axes are staggered with respect to the inner lateral bar unit.

In some exemplary embodiments, a distance between the first axis and the inner lateral bar unit is greater than a distance between the second axis and the inner lateral bar unit such that the second longitudinal bar unit is disposed between the inner lateral bar unit and the first longitudinal bar unit when folded.

In some exemplary embodiments, a distance between the third axis and the inner lateral bar unit is greater than a distance between the fourth axis and the inner lateral bar unit such that the fourth longitudinal bar unit is disposed between the inner lateral bar unit and the third longitudinal bar unit when folded.

In an exemplary embodiment, a distance between the first axis and the inner lateral bar unit is greater than a distance between the second axis and the inner lateral bar unit such that the second longitudinal bar unit is disposed between the inner lateral bar unit and the first longitudinal bar unit when folded; and a distance between the third axis and the inner lateral bar unit is greater than a distance between the fourth axis and the inner lateral bar unit such that the fourth longitudinal bar unit is disposed between the inner lateral bar unit and the third longitudinal bar unit when folded.

In some exemplary embodiments, the inner lateral unit includes an upper lateral bar and a lower lateral bar; each of the first, second, third and fourth longitudinal bar units includes an upper longitudinal bar and a lower longitudinal bar; and each of the inner lateral bar unit, and the first, second, third and fourth longitudinal bar units further includes one or more supports disposed between the upper and lower lateral or longitudinal bars.

In some exemplary embodiments, a foldable supporting assembly further includes a first coupler, a second coupler, and a plurality of third couplers. The first coupler is fixedly coupled with the first end of the inner lateral bar unit. The second coupler is fixedly coupled with the second end of the inner lateral bar unit. Each third coupler is fixedly coupled with the first end of a respective longitudinal bar unit in the first, second, third and fourth longitudinal bar units. The first end of the respective longitudinal bar unit is rotatably connected with the first or second end of the inner lateral bar unit by a fastener through a hole formed in the third coupler and a hole formed in the first or second coupler.

In some exemplary embodiments, the inner lateral unit includes an upper lateral bar and a lower lateral bar. Each of the first, second, third and fourth longitudinal bar units includes an upper longitudinal bar and a lower longitudinal bar. The first coupler includes a first upper coupler fixedly coupled with the first end of the upper lateral bar of the inner lateral bar unit, and a first lower coupler fixedly coupled with the first end of the lower lateral bar of the inner lateral bar unit. The second coupler includes a second upper coupler fixedly coupled with the second end of the upper lateral bar of the inner lateral bar unit, and a second lower coupler fixedly coupled with the second end of the lower lateral bar of the inner lateral bar unit. Each third coupler includes a third upper coupler fixedly coupled with the first end of the upper longitudinal bar of the respective longitudinal bar unit, and a third lower coupler fixedly coupled with the first end of the lower longitudinal bar of the respective longitudinal bar unit.

In an exemplary embodiment, the third upper or lower coupler is of a substantially "L" shape.

In some exemplary embodiments, a foldable supporting assembly further includes a plurality of receptacles spatially disposed at the upper longitudinal bars of the first, second, third and fourth longitudinal bar units. Each receptacle disposed at the first or third longitudinal bar unit is configured to removably receive a first end of a corresponding lateral supporting bar. Each receptacle disposed at the second or fourth longitudinal bar unit is configured to removably receive a second end of the corresponding lateral supporting bar.

In an exemplary embodiment, each receptacle in the plurality of receptacles is made of a bent piece.

In various exemplary embodiments, the present invention provides a bed frame including a foldable supporting assembly disclosed herein, a first outer lateral bar unit and a second outer lateral bar unit. The first outer lateral bar unit has a first end removably connected with the second end of the first longitudinal bar unit and a second end removably connected with the second end of the second longitudinal bar unit. The second outer lateral bar unit has a first end removably connected with the second end of the third longitudinal bar unit and a second end removably connected with the second end of the fourth longitudinal bar unit.

In some exemplary embodiments, each of the first, second, third and fourth longitudinal bar units includes an upper longitudinal bar and a lower longitudinal bar. The upper longitudinal bar includes a slot facing downwardly at the second end thereof. The lower longitudinal bar includes a first hole at the second end thereof. Each end of the first and second outer lateral bar units includes an upper receptacle at an upper portion thereof and a lower receptacle at a lower portion thereof. The upper receptacle is configured to receive the second end of the upper longitudinal bar of the corresponding first, second, third or fourth longitudinal bar unit, wherein the upper receptacle includes a pin removably engageable with the slot of the upper longitudinal bar. The lower receptacle is configured to receive the second end of the lower longitudinal bar of the corresponding first, second, third or fourth longitudinal bar unit, wherein the lower receptacle includes a second hole, wherein the lower longitudinal bar is connected with the lower receptacle by a fastener via the first and second holes.

In some exemplary embodiments, each of the first and second outer lateral bar units includes an upper lateral bar, a lower lateral bar, and a tubular piece fixedly connecting the ends of the upper and lower lateral bars.

The foldable supporting assemblies and bed frames of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

Figure 1:
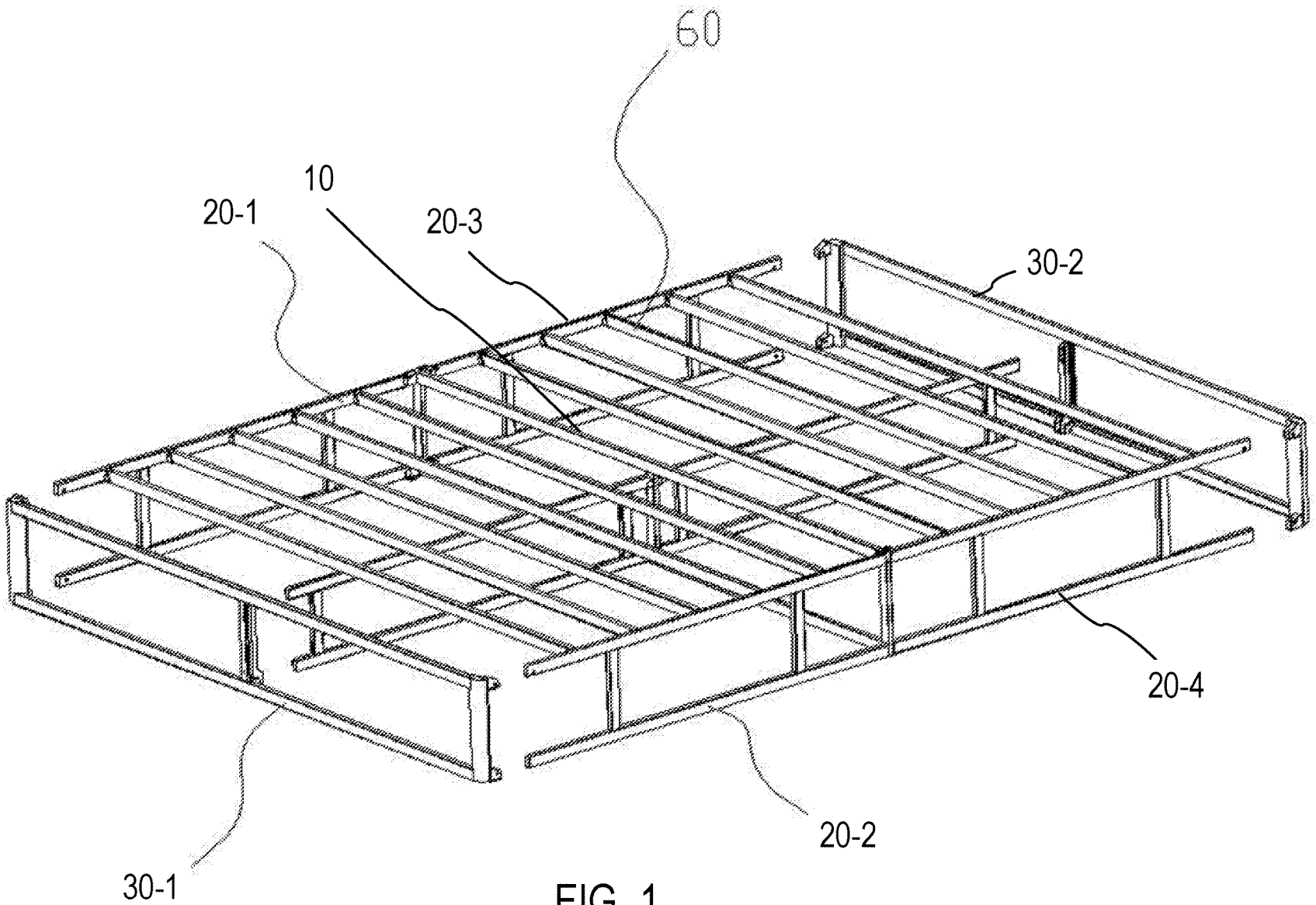
FIG. 1 is a partially disassembled perspective view illustrating an exemplary bed frame in accordance with exemplary embodiments of the present invention.
Figure 2:
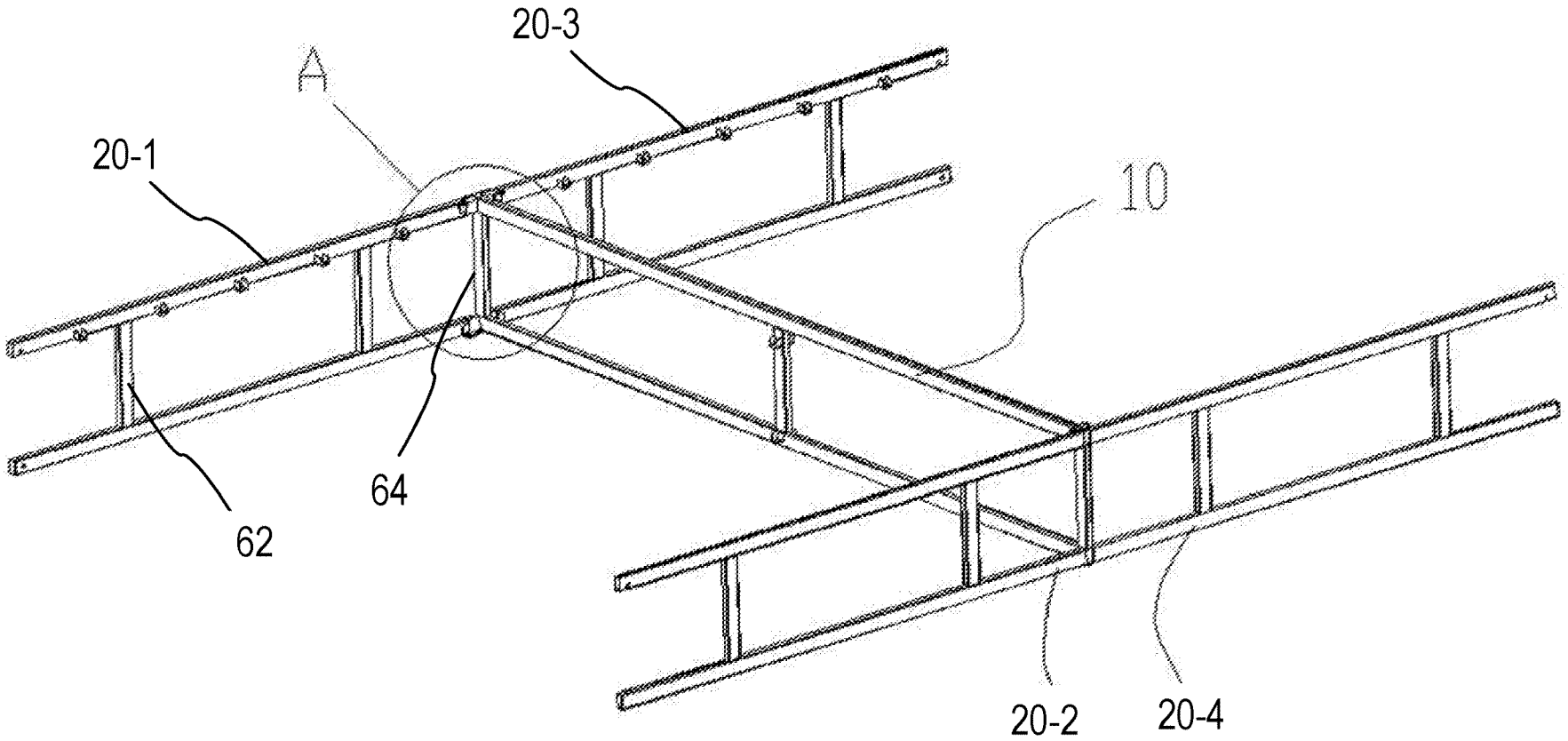
FIG. 2 is a perspective view illustrating an exemplary foldable supporting assembly in an unfolded state in accordance with exemplary embodiments of the present invention.
Figure 3:
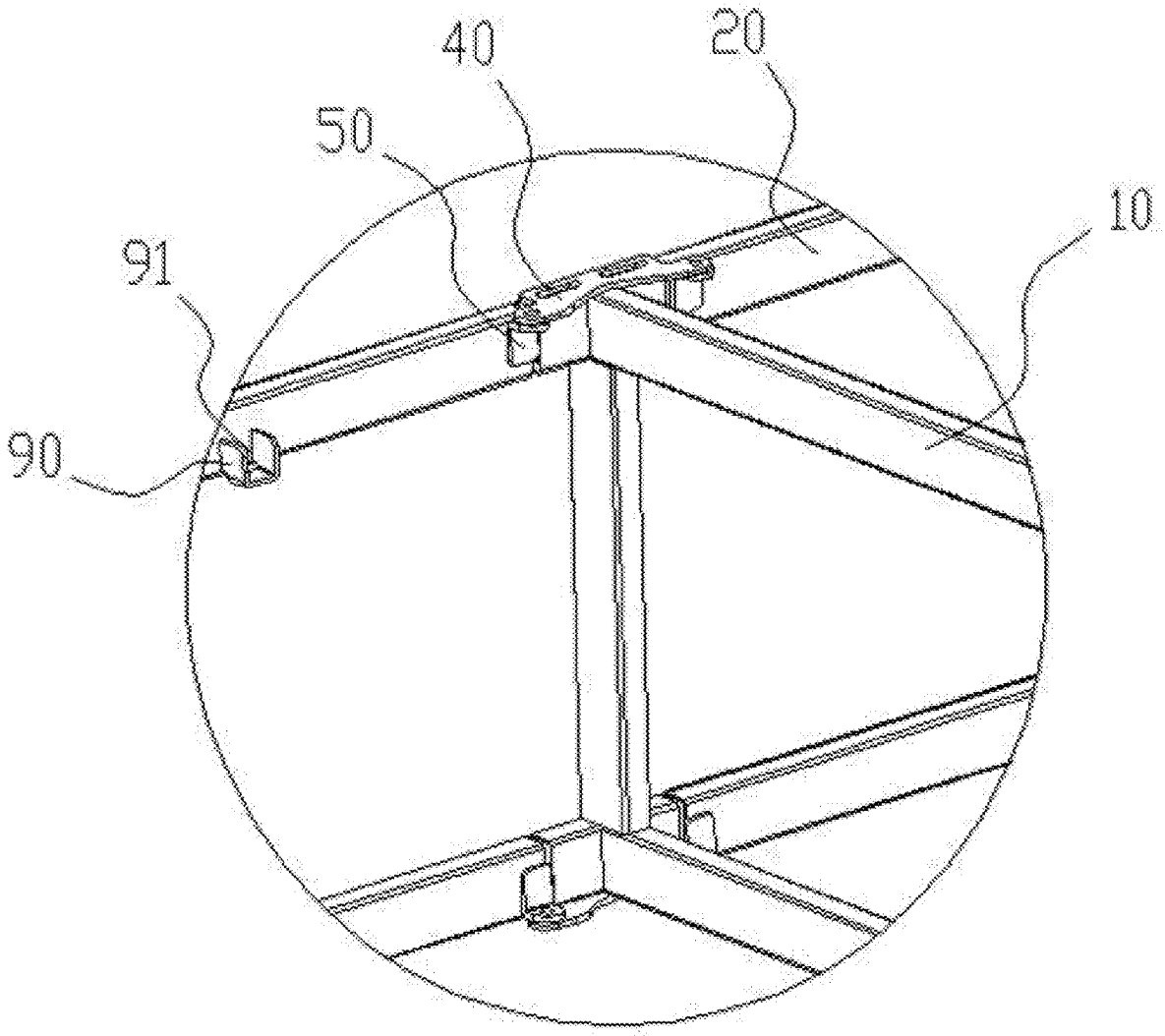
FIG. 3 is an enlarged view taken along circle A of FIG. 2.
Figure 4:
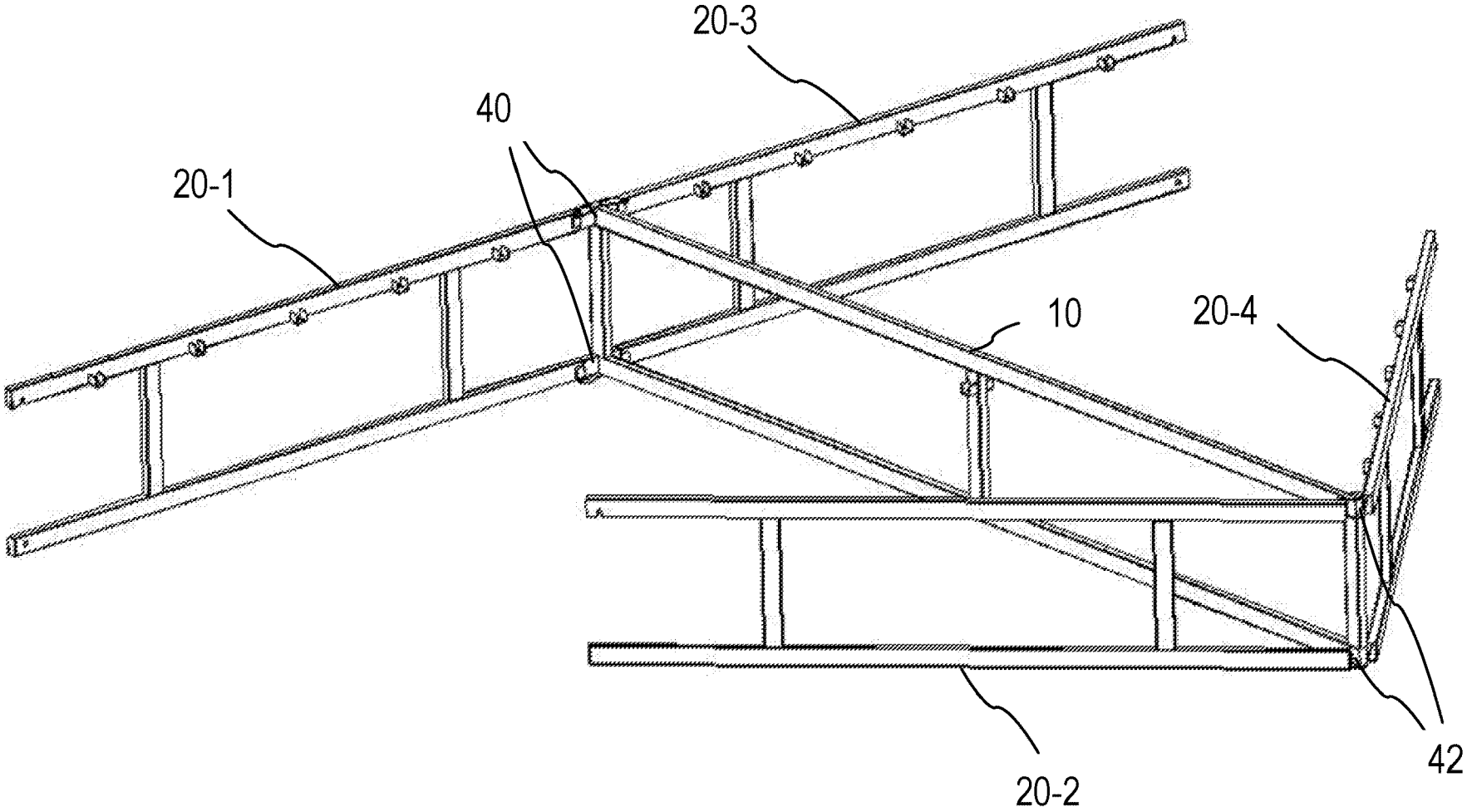
FIG. 4 is a perspective view illustrating an exemplary foldable supporting assembly in a first intermediate state in accordance with exemplary embodiments of the present invention.
Figure 5:
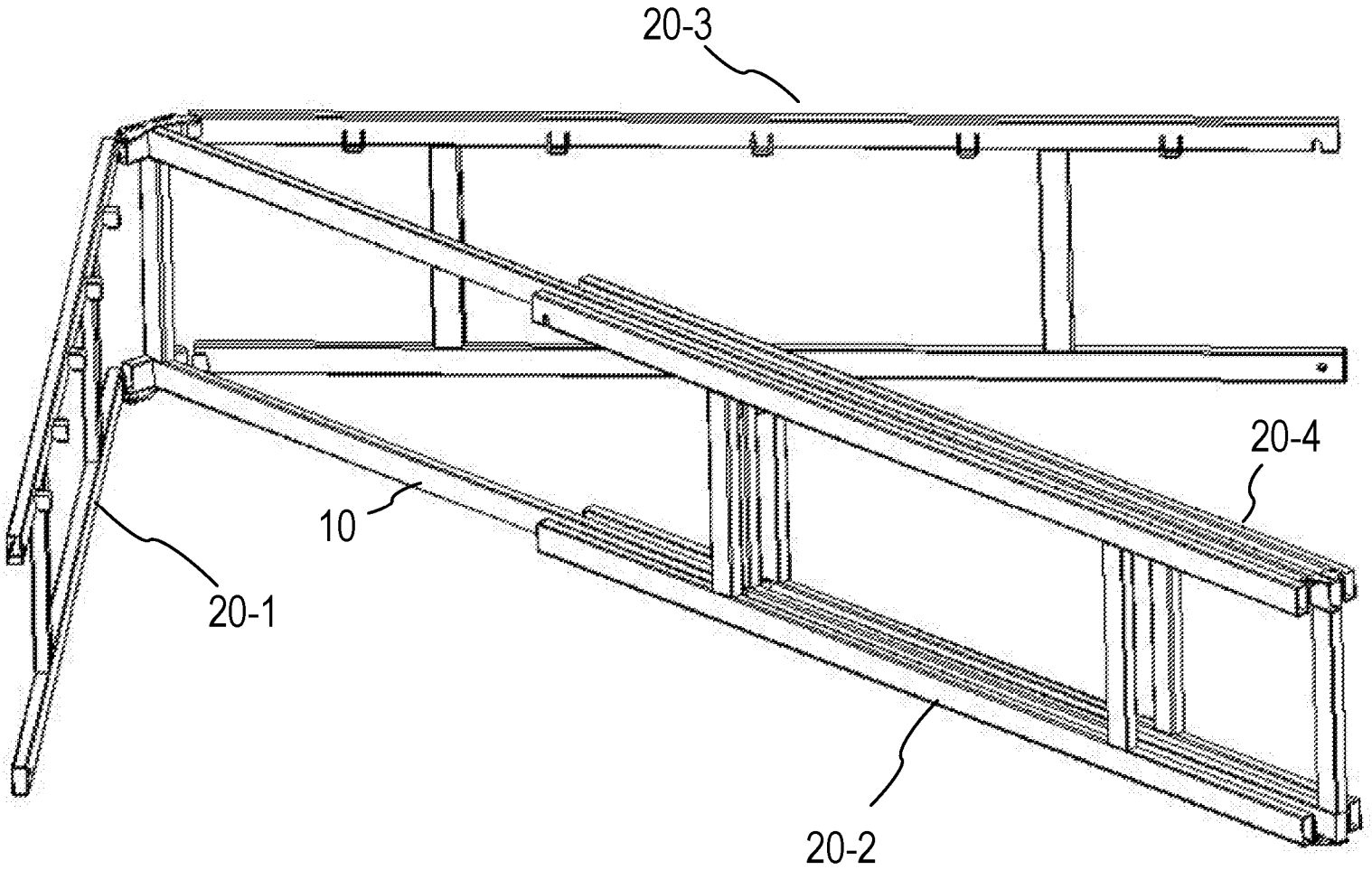
FIG. 5 is a perspective view illustrating an exemplary foldable supporting assembly in a second intermediate state in accordance with exemplary embodiments of the present invention.
Figure 6:
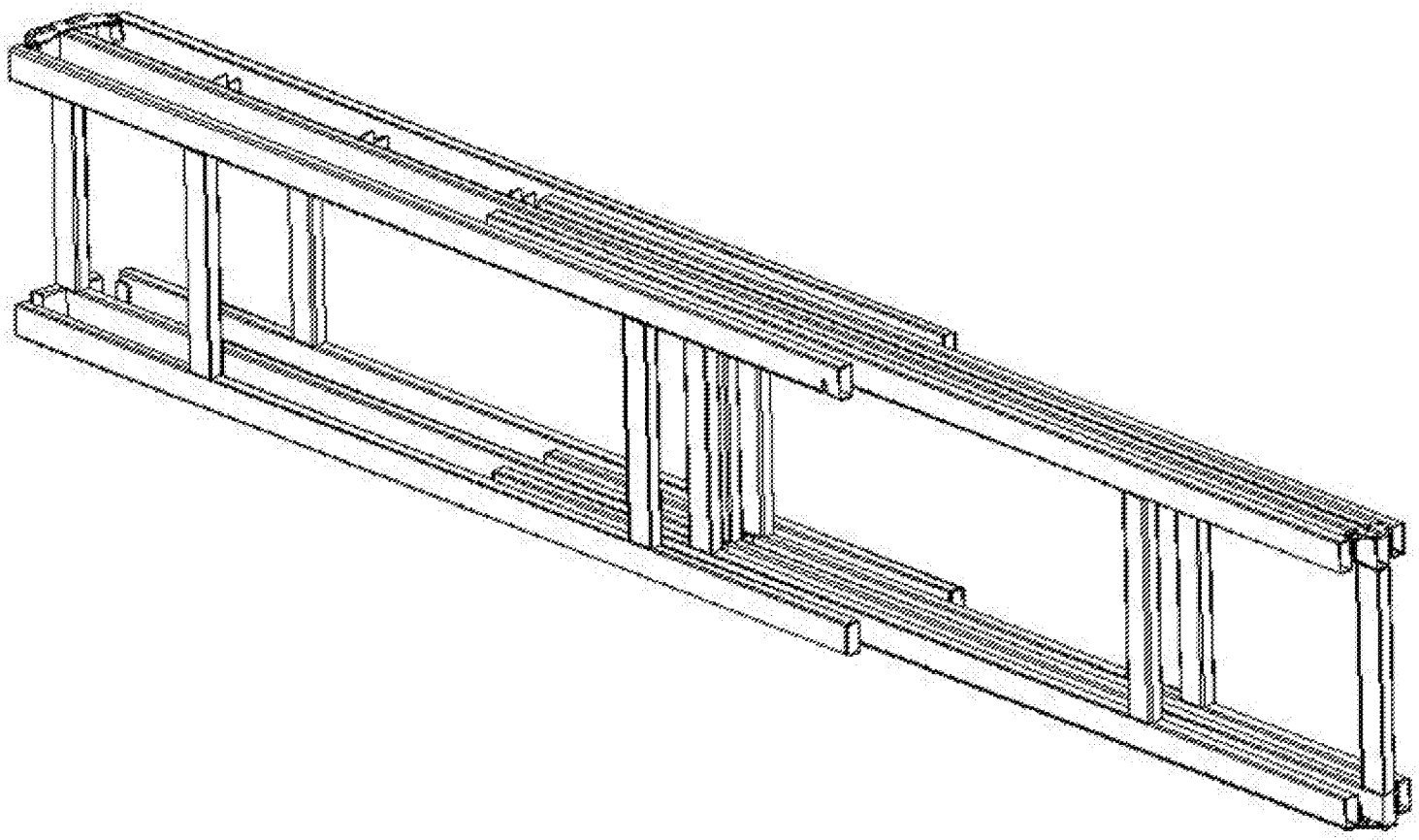
FIG. 6 is a perspective view illustrating an exemplary foldable supporting assembly in a folded state in accordance with exemplary embodiments of the present invention.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of foldable supporting assemblies and bed frames having such foldable supporting assemblies. The bed frames of the present invention can be of various sizes including but not limited to twin, full, queen and king sizes, and of various shapes including but not limited to rectangles and squares. They can be made of various materials including but not limited to metals (e.g., cast iron, steel, and aluminum), plastics and woods.

In general, a foldable supporting assembly of the present invention includes an inner lateral bar unit, first and second longitudinal bar units disposed at a first side of the inner lateral bar unit, and third and fourth longitudinal bar units disposed at a second side of the inner lateral bar unit. Each of the first, second, third and fourth longitudinal bar units has a first end rotatably connected with a first end or a second end of the inner lateral bar unit. The connections between the inner lateral bar unit with the first, second, third and fourth longitudinal bar unit can be configured substantially the same as each other or differently from each other. In some exemplary embodiments, the connections of the first ends of the first and second longitudinal bar units with the lateral bar unit are staggered (e.g., the connections are offset in the longitudinal direction of the foldable supporting assembly) such that when folded, one of the first and second longitudinal bar units is disposed between the inner lateral bar unit and the other one of the first and second longitudinal bar units. Similarly the connections of the first ends of the third and fourth longitudinal bar units with the lateral bar unit are staggered such that when folded, one of the third and fourth longitudinal bar units is disposed between the inner lateral bar unit and the other one of the third and fourth longitudinal bar units. In some exemplary embodiments, the connections of the first ends of the first and second longitudinal bar units with the lateral bar unit are not staggered or offset with each other. For instance, in an exemplary embodiment, the connections of the first ends of the first and second longitudinal bar units with the lateral bar unit are aligned with each other in the longitudinal direction of the foldable supporting assembly. Similarly, in some exemplary embodiments, the connections of the first ends of the third and fourth longitudinal bar units with the lateral bar unit are not staggered or offset with each other. In some exemplary embodiments, similar or substantially the same connectors or couplers are used to connect the inner lateral bar unit with each of the first, second, third and fourth longitudinal bar units.

By way of example, FIGS. 2-6 illustrate a foldable supporting assembly including inner lateral bar unit 10, first longitudinal bar unit 20-1, second longitudinal bar unit 20-2, third longitudinal bar unit 20-3, and fourth longitudinal bar unit 20-4. The inner lateral bar unit has a first end and a second end. Each of the first, second, third and fourth longitudinal bar units also has a first end and a second end.

The first and second longitudinal bar units are disposed at the first side of the inner lateral bar. The first end of the first longitudinal bar unit is rotatably connected with the first end of the inner lateral bar unit and the first end of the second longitudinal bar unit is rotatably connected with the second end of the inner lateral bar unit. The third and fourth longitudinal bar units are disposed at the second side of the inner lateral bar unit. The first end of the third longitudinal bar unit is rotatably connected with the first end of the inner lateral bar unit and the first end of the fourth longitudinal bar unit is rotatably connected with the second end of the inner lateral bar unit.

There are several ways to enable one longitudinal bar unit to be disposed between the inner lateral bar unit and another longitudinal bar unit when folded. As an example, FIGS. 2-6 illustrate that the first end of first longitudinal bar unit 20-1 is rotatably connected with the first end of inner lateral bar unit 10 and is rotatable with respect to the inner lateral bar unit along a first axis at the first side of the inner lateral bar unit. The first end of second longitudinal bar unit 20-2 is rotatably connected with the second end of the inner lateral bar unit and is rotatable with respect to the inner lateral bar unit along a second axis at the first side of the inner lateral bar unit. The first and second axes are staggered with respect to the inner lateral bar unit, e.g., the connections are offset in the longitudinal direction of the foldable supporting assembly. In some exemplary embodiments, a distance between the first axis and the inner lateral bar unit is different from a distance between the second axis and the inner lateral bar unit. As such, when folded, one of the first and second longitudinal bar units is disposed between the inner lateral bar unit and the other one of the first and second longitudinal bar units.

The distance between the first axis and the inner lateral bar unit can be greater or less than the distance between the second axis and the inner lateral bar unit. By way of example, FIGS. 2-6 illustrate the distance between the first axis and the inner lateral bar unit greater than the distance between the second axis and the inner lateral bar unit such that when folded, second longitudinal bar unit 20-2 is disposed between inner lateral bar unit 10 and first longitudinal bar unit 20-1.

Similarly, the first end of third longitudinal bar unit 20-3 is rotatably connected with the first end of inner lateral bar unit 10 and is rotatable with respect to the inner lateral bar unit along a third axis at the second side of the inner lateral bar unit. The first end of second longitudinal bar unit 20-2 is rotatably connected with the second end of the inner lateral bar unit and is rotatable with respect to the inner lateral bar unit along a fourth axis at the second side of the inner lateral bar unit. The third and fourth axes are staggered with respect to the inner lateral bar unit, e.g., a distance between the third axis and the inner lateral bar unit is different from a distance between the fourth axis and the inner lateral bar unit. As such, when folded, one of the third and fourth longitudinal bar units is disposed between the inner lateral bar unit and the other one of the third and fourth longitudinal bar units.

The distance between the third axis and the inner lateral bar unit can be greater or less than the distance between the fourth axis and the inner lateral bar unit. By way of example, FIGS. 2-6 illustrate the distance between the third axis and the inner lateral bar unit greater than the distance between the fourth axis and the inner lateral bar unit such that when folded fourth longitudinal bar unit 20-4 is disposed between inner lateral bar unit 10 and third longitudinal bar unit 20-3.

It should be noted that the axes (e.g., the first and second axes, or the third and fourth axes) are not necessarily have to be staggered to have one longitudinal bar unit disposed between the inner lateral bar unit and the other longitudinal bar unit. In some exemplary embodiments, there is no staggering or offsetting at one side or each side of the inner lateral bar. For instance, in an exemplary embodiment, the connections of the first ends of the first and second longitudinal bar units with the lateral bar unit are aligned with each other, and/or the connections of the first ends of the third and fourth longitudinal bar units with the lateral bar unit are aligned with each other in the longitudinal direction of the foldable supporting assembly.

It should also be noted that in some exemplary embodiments, the inner lateral bar unit is longer than the combination of the first and second longitudinal bar units or longer than the combination of the third and fourth longitudinal bar units. As such, there is no overlapping of the longitudinal bar units at one side or each side of the inner lateral bar.

In some exemplary embodiments, the foldable supporting assembly includes a variety of couplers to couple the inner lateral bar unit with the first, second, third and fourth longitudinal bar units. For instance, by way of example, FIGS. 2-6 illustrate first coupler 40, second coupler 42 and a plurality of third couplers 50. The first and second couplers are coupled with the first and second ends of the inner lateral bar unit, respectively. In some exemplary embodiments, the first and second couplers are fixedly coupled with the first and second ends of the inner lateral bar unit, respectively. The third coupler is coupled with the first end of the first, second, third, or fourth longitudinal bar unit. In some exemplary embodiments, the third coupler is fixedly coupled with the first end of the first, second, third, or fourth longitudinal bar unit. In an exemplary embodiment, each of the first and second couplers is formed with a hole at each of the first and second sides of the inner lateral bar unit. The first end of the respective longitudinal bar unit is rotatably connected with the first or second end of the inner lateral bar unit by a fastener through a hole formed in the third coupler and a hole formed in the first or second coupler.

It should be noted that a bar unit can include a single bar or a stack of bars. A stack of bars can include two, three or more bars arranged one over another. The two, three or more bars can be but not necessarily have to be in direct contact. In additional, a bar can be a whole bar or made of two, three or more segments connected (fixed or movable) with each other. Similarly, a coupler can be a single coupler or a stack of couplers.

By way of example, FIGS. 2-6 illustrate the inner lateral unit including an upper lateral bar and a lower lateral bar, and each of the first, second, third and fourth longitudinal bar units including an upper longitudinal bar and a lower longitudinal bar. In such exemplary embodiments, the first coupler includes a first upper coupler and a first lower coupler. The first upper coupler is fixedly coupled with the first end of the upper lateral bar of the inner lateral bar unit, and the first lower coupler is fixedly coupled with the first end of the lower lateral bar of the inner lateral bar unit. Similarly, the second coupler includes a second upper coupler and a second lower coupler. The second upper coupler is fixedly coupled with the second end of the upper lateral bar of the inner lateral bar unit, and the second lower coupler is fixedly coupled with the second end of the lower lateral bar of the inner lateral bar unit. Each third coupler includes a third upper coupler and a third lower coupler. The third upper coupler is fixedly coupled with the first end of the upper longitudinal bar of the respective longitudinal bar unit, and the third lower coupler is fixedly coupled with the first end of the lower longitudinal bar of the respective longitudinal bar unit.

The couplers can be of any suitable shape. In some exemplary embodiments, the third upper or lower coupler is of a substantially "L" shape.

In some exemplary embodiments, each of the first, second, third and fourth longitudinal bar units further includes one or more supports such as support 62 disposed between the upper and lower longitudinal bars. Similarly, in some exemplary embodiments, the inner lateral bar unit includes one or more supports disposed between the upper and lower lateral bars. In an exemplary embodiment, the inner lateral bar unit includes a support such as support 64 disposed between the upper and lower lateral bars at each end of the inner lateral bar unit.

In some exemplary embodiments, the foldable supporting assembly includes a plurality of receptacles such as receptacle 91 spatially disposed at the upper longitudinal bars of the first, second, third and fourth longitudinal bar units. The receptacles are configured to receive a plurality of lateral supporting bars such as lateral supporting bar 60 illustrated in FIG. 1. For instance, a receptacle or each receptacle disposed at the first or third longitudinal bar unit is configured to removably receive a first end of a corresponding lateral supporting bar, and a receptacle or each receptacle disposed at the second or fourth longitudinal bar unit is configured to removably receive a second end of the corresponding lateral supporting bar.

The receptacles can be made of any suitable material and by any suitable means. In an exemplary embodiment, receptacle 91 is made of a bent piece such as bent piece 90.

A bed frame of the present invention includes a foldable supporting assembly disclosed herein. In various exemplary embodiments, a bed frame also includes a first outer lateral bar unit and a second outer lateral bar unit such as first outer lateral bar unit 30-1 and second outer lateral bar unit 30-2 illustrated in FIG. 1. The first outer lateral bar unit has a first end removably connected with the second end of the first longitudinal bar unit and a second end removably connected with the second end of the second longitudinal bar unit. The second outer lateral bar unit has a first end removably connected with the second end of the third longitudinal bar unit and a second end removably connected with the second end of the fourth longitudinal bar unit. In some exemplary embodiments, the first or second outer lateral bar unit is connected with the first, second, third, or fourth longitudinal bar unit by a connecting structure.

Figure 7:
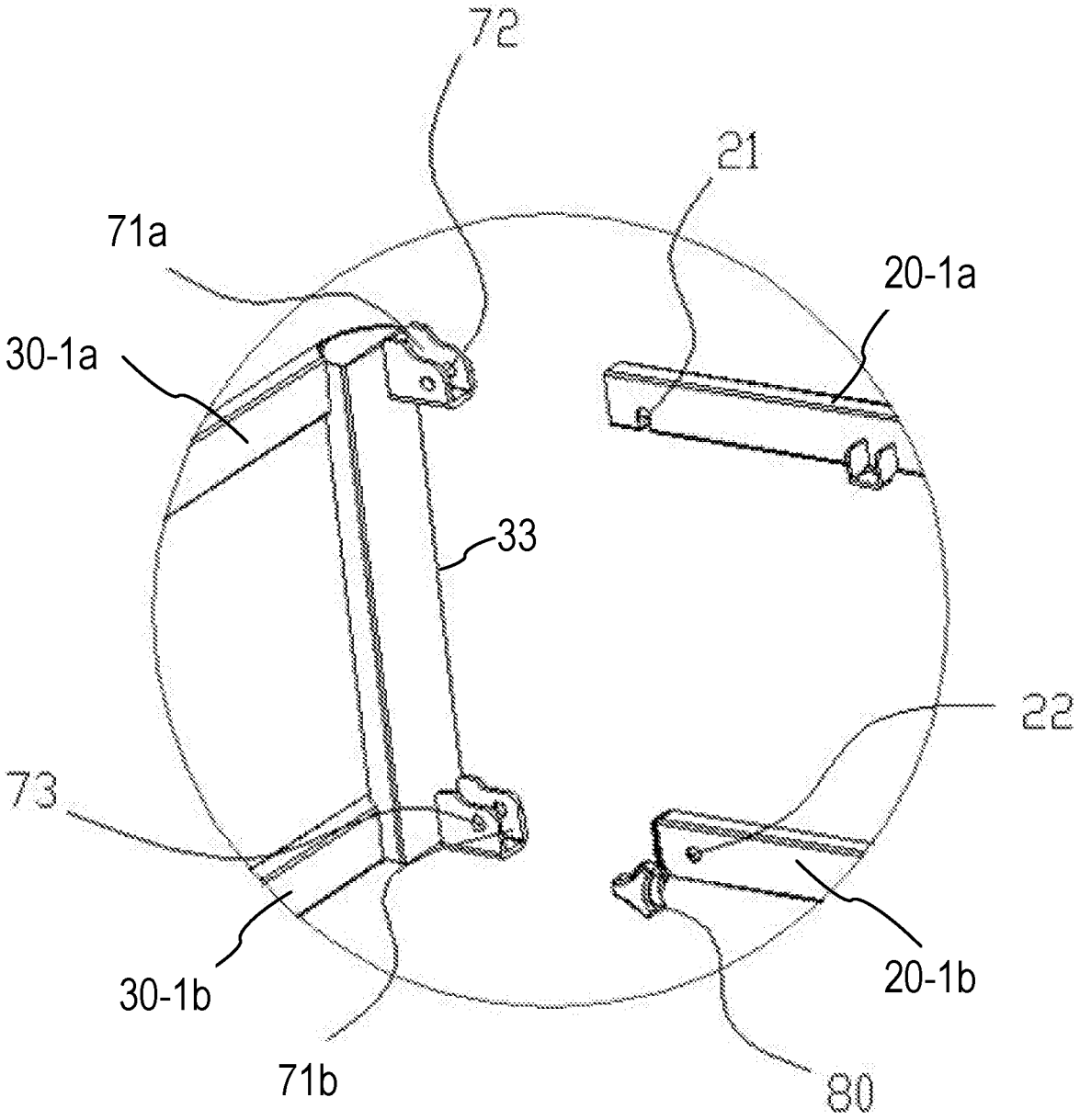
FIG. 7 is a perspective view illustrating an exemplary connecting structure in accordance with exemplary embodiments of the present invention.

By way of example, FIG. 7 illustrates an exemplary connecting structure connecting an end of first outer lateral bar unit 30-1 with first longitudinal bar unit 20-1 which includes upper longitudinal bar 20-1*a* and lower longitudinal bar 20-1*b*. The exemplary connecting structure includes an upper receptacle such as upper receptacle 71*a* and a lower receptacle such as lower receptacle 71*b*. The upper receptacle is disposed at an upper portion of an end of the first outer lateral bar unit, and configured to receive and movably couple with an end of upper longitudinal bar 20-1*a* of first longitudinal bar unit 20-1. The lower receptacle is disposed at a lower portion of the end of the first outer lateral bar unit, and configured to receive and fixedly couple with an end of lower longitudinal bar 20-1*b* of longitudinal bar unit 20-1. As such, the bed frame of the present invention is both flexible and stable.

In some exemplary embodiments, the upper longitudinal bar includes a slot such as slot 21 facing downward at the end of the upper longitudinal bar. Corresponding to the slot, the upper receptacle includes a pin such as pin 72 to movably engage with the slot of the upper longitudinal bar.

In some exemplary embodiments, the lower longitudinal bar includes a hole such as first hole 22 at the end of the lower longitudinal bar. Corresponding to the first hole, the lower receptacle includes a second hole such as second hole 73. In an exemplary embodiment, the lower longitudinal bar is connected with the lower receptacle by a fastener such as fastener 80 (e.g., locking bolt, locking screw) via the first and second holes.

In some exemplary embodiments, the first or second outer lateral bar unit includes an upper outer lateral bar, a lower outer lateral bar, and a tubular piece fixedly connecting the ends of the upper and lower outer lateral bars. For instance, by way of example, FIG. 7 illustrates the first outer lateral bar unit includes upper outer lateral bar 30-1*a*, lower outer lateral bar 30-1*b*, and tubular piece 33 fixedly connecting the ends of the upper and lower outer lateral bars. In some exemplary embodiments, a tubular piece is disposed at each end of the first or second outer lateral bar unit.

The foldable supporting assembly of the present invention can be folded and unfolded while the lateral and longitudinal bar units are connected with each other. As such, there is no need to assemble or disassemble these parts, and they require less space for shipping, transportation and storage. Moreover, the outer inner lateral bar units can be easily installed or removed. Further, with the connecting structures, the bed frames are flexible and stable. As such, using a bed frame of the present invention to make a comfortable bed is not time consuming and does not require much effort.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first longitudinal bar unit could be termed a second longitudinal bar unit, and, similarly, a second longitudinal bar unit could be termed a first longitudinal bar unit, without changing the meaning of the description, so long as all occurrences of the "first longitudinal bar unit" are renamed consistently and all occurrences of the "second longitudinal bar unit" are renamed consistently.

What is claimed is:

1. A bed frame comprising:

an inner lateral bar unit;

a first outer lateral bar unit disposed at a first side of the inner lateral bar unit;

a second outer lateral bar unit disposed at a second side of the inner lateral bar unit;

first and second longitudinal bar units disposed between the inner and first outer lateral bar units; and third and fourth longitudinal bar units disposed between the inner and second outer lateral bar units, wherein each of the first, second, third and fourth longitudinal bar units has a first end rotatably connected with a first end or a second end of the inner lateral bar unit, and a second end connected with a first end or a second end of the first or second outer lateral bar unit.

2. The bed frame of claim 1, wherein:

a first coupler is fixedly coupled with the first end of the inner lateral bar unit;

a second coupler is fixedly coupled with the second end of the inner lateral bar unit; and a third coupler of a substantially "L" shape is fixedly coupled with the first end of a respective longitudinal bar unit in the first, second, third and fourth longitudinal bar units;

wherein the first end of the respective longitudinal bar unit is rotatably connected with the first or second end of the inner lateral bar unit by a fastener through a hole formed in the third coupler and a hole formed in the first or second coupler.

3. The bed frame of claim 1, wherein each of the inner lateral bar unit, the first and second outer lateral bar units, and the first and second longitudinal bar units comprises an upper bar, a lower bar, and one or more supports disposed between the upper and lower bars.

4. The bed frame of claim 1, wherein each end of the first and second outer lateral bar units comprises a receptacle to receive the second end of the corresponding first, second, third or fourth longitudinal bar unit.

5. The bed frame of claim 1, wherein each of the first, second, third and fourth longitudinal bar units comprises an upper longitudinal bar and a lower longitudinal bar, wherein the upper longitudinal bar comprises a slot facing downwardly at the second end thereof; and the lower longitudinal bar comprises a first hole at the second end thereof; and each end of the first and second outer lateral bar units comprises:

an upper receptacle at an upper portion thereof to receive the second end of the upper longitudinal bar of the corresponding first, second, third or fourth longitudinal bar unit, wherein the upper receptacle comprises a pin removably engageable with the slot of the upper longitudinal bar; and a lower receptacle at a lower portion thereof to receive the second end of the lower longitudinal bar of the corresponding first, second, third or fourth longitudinal bar unit, wherein the lower receptacle comprises a second hole, wherein the lower longitudinal bar is connected with the lower receptacle by a fastener via the first and second holes.

6. The bed frame of claim 5, further comprising:

a plurality of receptacles, each made of a bent piece, wherein the plurality of receptacles is spatially disposed at the upper longitudinal bars of the first, second, third and fourth longitudinal bar units; and a plurality of lateral supporting bars, each having a first end removably received in a receptacle at the first or third longitudinal bar unit, and a second end removably received in a receptacle at the second or fourth longitudinal bar unit.

7. A foldable supporting assembly of a bed frame, comprising:

an inner lateral bar unit having a first end and a second end;

first and second longitudinal bar units disposed at a first side of the inner lateral bar unit, each having a first end and a second end, wherein the first end of the first longitudinal bar unit is rotatably connected with the first end of the inner lateral bar unit and the first end of the second longitudinal bar unit is rotatably connected with the second end of the inner lateral bar unit such that when folded, one of the first and second longitudinal bar units is disposed between the inner lateral bar unit and the other one of the first and second longitudinal bar units; and third and fourth longitudinal bar units disposed at a second side of the inner lateral bar unit, each having a first end and a second end, wherein the first end of the third longitudinal bar unit is rotatably connected with the first end of the inner lateral bar unit and the first end of the fourth longitudinal bar unit is rotatably connected with the second end of the inner lateral bar unit such that when folded, one of the third and fourth longitudinal bar units is disposed between the inner lateral bar unit and the other one of the third and fourth longitudinal bar units when folded.

8. The foldable supporting assembly of claim 7, wherein the first longitudinal bar unit is rotatable with respect to the inner lateral bar unit along a first axis at the first side of the inner lateral bar unit;

the second longitudinal bar unit is rotatable with respect to the inner lateral bar unit along a second axis at the first side of the inner lateral bar unit;

the first and second axes are staggered with respect to the inner lateral bar unit;

the third longitudinal bar unit is rotatable with respect to the inner lateral bar unit along a third axis at the second side of the inner lateral bar unit;

the fourth longitudinal bar unit is rotatable with respect to the inner lateral bar unit along a fourth axis at the second side of the inner lateral bar unit; and the third and fourth axes are staggered with respect to the inner lateral bar unit.

9. The foldable supporting assembly of claim 8, wherein a distance between the first axis and the inner lateral bar unit is greater than a distance between the second axis and the inner lateral bar unit such that the second longitudinal bar unit is disposed between the inner lateral bar unit and the first longitudinal bar unit when folded.

10. The foldable supporting assembly of claim 8, wherein a distance between the third axis and the inner lateral bar unit is greater than a distance between the fourth axis and the inner lateral bar unit such that the fourth longitudinal bar unit is disposed between the inner lateral bar unit and the third longitudinal bar unit when folded.

11. The foldable supporting assembly of claim 8, wherein:

a distance between the first axis and the inner lateral bar unit is greater than a distance between the second axis and the inner lateral bar unit such that the second longitudinal bar unit is disposed between the inner lateral bar unit and the first longitudinal bar unit when folded; and a distance between the third axis and the inner lateral bar unit is greater than a distance between the fourth axis and the inner lateral bar unit such that the fourth longitudinal bar unit is disposed between the inner lateral bar unit and the third longitudinal bar unit when folded.

12. The foldable supporting assembly of claim 7, wherein:

the inner lateral unit comprises an upper lateral bar and a lower lateral bar;

each of the first, second, third and fourth longitudinal bar units comprises an upper longitudinal bar and a lower longitudinal bar; and each of the inner lateral bar unit, and the first, second, third and fourth longitudinal bar units further comprises one or more supports disposed between the upper and lower lateral or longitudinal bars.

13. The foldable supporting assembly of claim 7, further comprises:

a first coupler fixedly coupled with the first end of the inner lateral bar unit;

a second coupler fixedly coupled with the second end of the inner lateral bar unit;

a plurality of third couplers, each fixedly coupled with the first end of a respective longitudinal bar unit in the first, second, third and fourth longitudinal bar units;

wherein the first end of the respective longitudinal bar unit is rotatably connected with the first or second end of the inner lateral bar unit by a fastener through a hole formed in the third coupler and a hole formed in the first or second coupler.

14. The foldable supporting assembly of claim 13, wherein:

the inner lateral unit comprises an upper lateral bar and a lower lateral bar;

each of the first, second, third and fourth longitudinal bar units comprises an upper longitudinal bar and a lower longitudinal bar;

the first coupler comprises a first upper coupler fixedly coupled with the first end of the upper lateral bar of the inner lateral bar unit, and a first lower coupler fixedly coupled with the first end of the lower lateral bar of the inner lateral bar unit;

the second coupler comprises a second upper coupler fixedly coupled with the second end of the upper lateral bar of the inner lateral bar unit, and a second lower coupler fixedly coupled with the second end of the lower lateral bar of the inner lateral bar unit;

each third coupler comprises a third upper coupler fixedly coupled with the first end of the upper longitudinal bar of the respective longitudinal bar unit, and a third lower coupler fixedly coupled with the first end of the lower longitudinal bar of the respective longitudinal bar unit.

15. The foldable supporting assembly of claim 14, wherein the third upper or lower coupler is of a substantially "L" shape.

16. The foldable supporting assembly of claim 14, further comprising:

a plurality of receptacles spatially disposed at the upper longitudinal bars of the first, second, third and fourth longitudinal bar units, wherein each receptacle disposed at the first or third longitudinal bar unit is configured to removably receive a first end of a corresponding lateral supporting bar; and each receptacle disposed at the second or fourth longitudinal bar unit is configured to removably receive a second end of the corresponding lateral supporting bar.

17. The foldable supporting assembly of claim 16, wherein each receptacle in the plurality of receptacles is made of a bent piece.

18. A bed frame, comprising:

the foldable supporting assembly of claim 7;

a first outer lateral bar unit having a first end removably connected with the second end of the first longitudinal bar unit and a second end removably connected with the second end of the second longitudinal bar unit; and a second outer lateral bar unit having a first end removably connected with the second end of the third longitudinal bar unit and a second end removably connected with the second end of the fourth longitudinal bar unit.

19. The bed frame of claim 18, wherein each of the first, second, third and fourth longitudinal bar units comprises an upper longitudinal bar and a lower longitudinal bar, wherein the upper longitudinal bar comprises a slot facing downwardly at the second end thereof; and the lower longitudinal bar comprises a first hole at the second end thereof; and each end of the first and second outer lateral bar units comprises:

an upper receptacle at an upper portion thereof to receive the second end of the upper longitudinal bar of the corresponding first, second, third or fourth longitudinal bar unit, wherein the upper receptacle comprises a pin removably engageable with the slot of the upper longitudinal bar; and a lower receptacle at a lower portion thereof to receive the second end of the lower longitudinal bar of the corresponding first, second, third or fourth longitudinal bar unit, wherein the lower receptacle comprises a second hole, wherein the lower longitudinal bar is connected with the lower receptacle by a fastener via the first and second holes.

20. The bed frame of claim 18, further comprising:

each of the first and second outer lateral bar units comprises an upper lateral bar, a lower lateral bar, and a tubular piece fixedly connecting the ends of the upper and lower lateral bars.

* * * * *